United States Patent [19]

Lockshaw

[11] 4,016,840

[45] Apr. 12, 1977

[54] ROTARY-VALVE DEVICE FOR INTERNAL-COMBUSTION ENGINES

[76] Inventor: John E. Lockshaw, 519 Las Riendas Drive, Fullerton, Calif. 92635

[22] Filed: May 5, 1975

[21] Appl. No.: 574,236

[52] U.S. Cl. ..... 123/75 B; 123/32 F; 123/41.4; 123/80 BA; 123/190 R; 123/190 BD

[51] Int. Cl.[2] ..... F02M 25/06

[58] Field of Search ..... 123/32 F, 32 ST, 32 SP, 123/75 B, 191 S, 191 SP, 41.4, 190 R, 190 B, 190 BB, 190 BD, 80 R, 80 BA

[56] References Cited

UNITED STATES PATENTS

| | | | |
|---|---|---|---|
| 1,267,929 | 5/1918 | Stevens | 123/41.4 |
| 1,380,742 | 6/1921 | Sallee | 123/41.4 |
| 1,413,213 | 4/1922 | Badger | 123/190 BB |
| 2,007,608 | 7/1935 | Kettering | 123/75 B |
| 2,142,325 | 1/1939 | McLoren | 123/190 BB |
| 3,896,781 | 7/1975 | Smith | 123/32 ST |
| 3,906,922 | 9/1975 | Dune Jr. | 123/32 ST |

*Primary Examiner*—Wendell E. Burns
*Assistant Examiner*—David D. Reynolds
*Attorney, Agent, or Firm*—Francis X. LoJacono, Sr.

[57] ABSTRACT

A rotary valve device for internal-combustion engines, said device comprising an elongated, tubular drum having an exhaust-manifold system disposed therein and a plurality of fuel passages, forming a fuel-intake system having fuel-intake ports and fuel-outlet ports positioned in the peripheral wall of the drum, whereby lean and rich fuel mixtures can be separately but simultaneously deposited in each combustion chamber of an internal-combustion engine, as the tubular drum rotates within the cylinder head, so that a complete burning of the fuel takes place. A cooling means, such as a water jacket, is interposed between the inner, tubular, manifold-exhaust conduit and the fuel passages — the jacket being provided with openings at the terminating ends thereof for connecting the water flow to the cooling system of a conventional-type engine.

13 Claims, 9 Drawing Figures

Fig. 3.
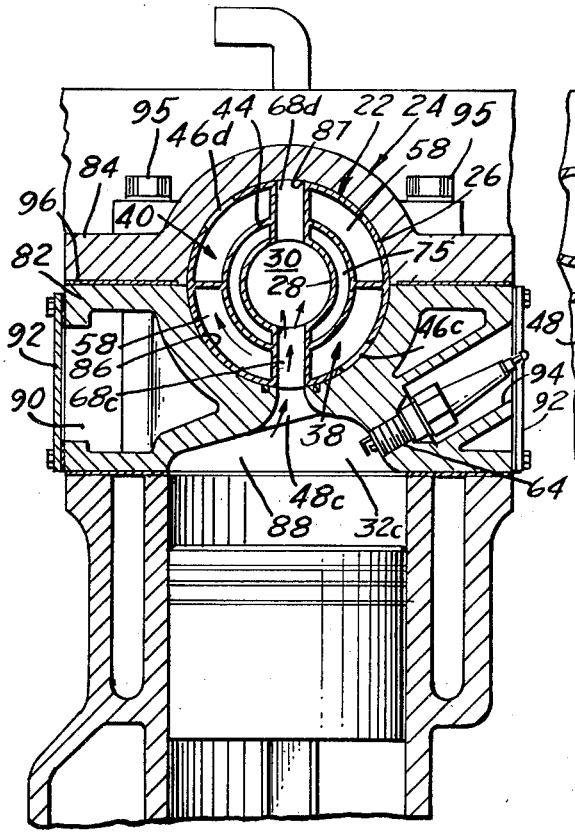
Fig. 4.
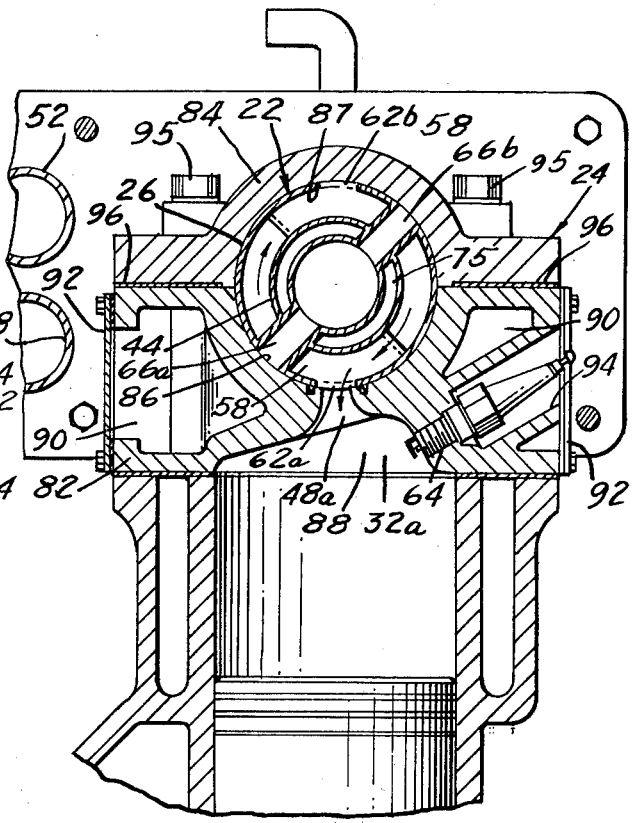
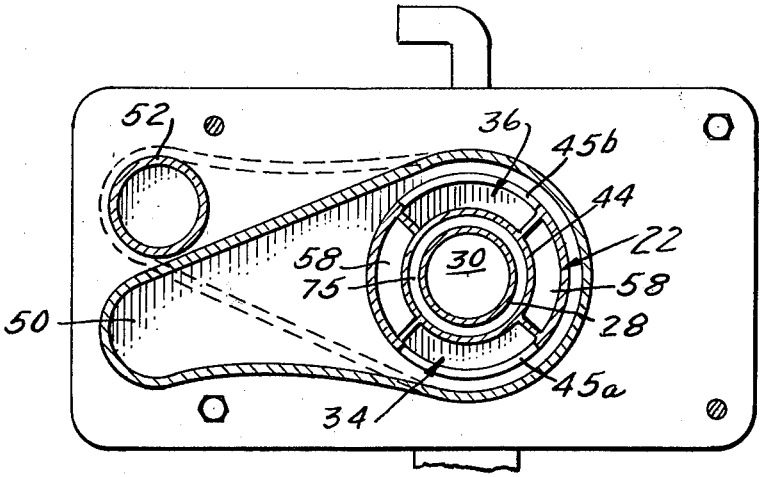
Fig. 5.

ROTARY-VALVE DEVICE FOR INTERNAL-COMBUSTION ENGINES

BACKGROUND

1. Field of the Invention

This invention relates to a valve system for internal-combustion engines and, more particularly, to a rotary-valve system providing a separate but simultaneous deposition of lean and rich fuel mixtures within each combustion chamber of an engine.

2. Description of the Prior Art

At the present time, there are numerous varieties of internal-combustion engines in use, and others being tried. These engines incorporate many unique designs and various sizes wherein changes have been made in camshaft design, valves, pistons, lubrication and fuel systems — from mechanical to electrical operations. Each of these various types and designs of internal-combustion engines has certain features and principles common with the others — the major three universal and basic requirements being air, fuel and ignition system — in order to render any of these engines operable. For the numerous internal-combustion engines there are as many end results — that is, differences in displacement, horsepower, burning rate, r.p.m. requirements, etc.

However, in recent years two important problems have arisen with respect to the use of internal-combustion engines, especially with respect to the reciprocating type wherein cylinders, pistons, connecting rods and crankshafts are required.

These problems are first, and foremost, air pollution — the other being the development of an energy crisis, particularly with respect to the fuel shortage.

Hence, not only have these types of engines become very complicated in their construction and expensive to manufacture, but they are inherently inefficient in their fuel-burning capacity. This lack of complete burning of fuel creates an air-pollution material which rapidly mixes with the atmosphere and is activated by the sun's rays to create what is referred to as "smog."

In recent years, many apparatuses have been devised for installation within the internal-combustion engine for the purpose of controlling the unburned contaminants that are discharged therefrom. However, even with such aids as exhaust recirculation, catalytic converters, and new carburetors, to name a few, contamination has not been controlled, due mainly to incomplete burning of the fuel within the engine. Thus, excessive use of fuel and the creation of air pollution still exist today.

Therefore, a more efficient means of providing a complete burning of fuel is necessary. This can be provided by a novel rotary-valve system as hereinafter described. Rotary valve devices are, in themselves, known in the art — such as the types discussed in "Valve Mechanisms for High-Speed Engines," by Philip H. Smith — yet the designs and functions of these devices do not provide the overall answers to the problems as herein stated.

SUMMARY

The present invention comprises a rotary-valve device adapted for use with internal-combustion engines, wherein the rotary valve comprises a ported drum or barrel having its axis at right angles to the cylinders of the engine, thus being operably positioned within the cylinder head along the length thereof.

The rotary-valve device is driven by the typical timing belt drive as generally used with such engines, wherein the valve and exhaust ports, in conjunction with a suitable gearing ratio relative to the engine crankshaft, can be designed to line up at the required timing intervals with throughways in the cylinder head.

The rotary valve includes therein an exhaust manifold having a longitudinal exhaust conduit centrally disposed along the axis of the drum, wherein enclosed exhaust ports extend radially outward therefrom so as to sequentially communicate with each cylinder chamber of the engine, and thus provide an exhaust system separate and distinct from the fuel-intake system.

The fuel-intake system includes a plurality of fuel passages whereby rich fuel mixture can be released to the combustion chamber separately from the lean-fuel mixture. The lean-fuel mixture is received in a single compartment having interrelated passages to provide a lean-fuel mixture at all times to all corresponding lean-mixture-outlet ports. The outlet ports of both the rich and lean fuel mixtures are juxtapositioned, so that both mixtures are simultaneously deposited within the combustion chamber at proper timed intervals — thus providing a complete burning of the fuel therein.

Each rich-fuel passage is provided with an inlet port which is positioned within a fuel chamber, the fuel chamber being connected to the rich-fuel side of the engine system. Similarly, the lean mixture is transported to the lean-mixture compartment through inlet ports thereof which are arranged to be located in a lean-mixture-fuel chamber, which in turn is connected to the lean-fuel side of the fuel system.

Included within the valve drum is a cooling means comprising a longitudinal water jacket disposed between the exhaust conduit and the fuel passage and fuel compartment, whereby water is allowed to continuously flow therethrough to provide an even temperature throughout the device. Thus, expansion and contraction of the device is held to a minimum, without adversely affecting its sealing qualities or free operation.

OBJECTIVES AND ADVANTAGES

The present invention has for an important objective the provision wherein substantially all fuel is completely burned within an engine chamber, thereby providing a more efficient internal-combustion engine.

It is another objective of the invention to provide a rotary-valve device that simultaneously but separately deposits a lean and a rich fuel mixture into the combustion chamber of an engine, wherein the rich mixture is for combustion by spark ignition and the lean mixture allows a larger portion of air and oxygen within the cylinders to complete the burning of most of the gases.

It is further another objective of the present invention to provide a rotary valve having a separate exhaust system and a separate fuel-intake system.

It is a further objective of the invention to provide a rotary-valve device that includes a water-cooling means whereby varying temperatures can be controlled, thereby preventing excessive expansion and contraction of the drum — and thus, in turn, providing a more efficient sealing, and free rotation of the valve drum within the cylinder head.

A still further objective of the invention is to provide a rotary-valve device that is adaptable to existing engine designs wherein the power unit is virtually unchanged below the cylinder-head joint.

It is another objective of the invention to provide a rotary-valve device that is simple and rugged in construction, and has a more dependable and durable life.

And still a further objective of the invention is to provide a rotary-valve device that includes a water-cooled exhaust jacket encircling the main exhaust passage within the valve cylinder, thereby lowering the temperature around the intake passages and also minimizing expansion and contraction of the valve cylinder.

It is still another objective of the present invention to provide a rotary valve that is easy to service and maintain.

Yet another objective of the present invention is to provide a rotary valve of this character that has a slower valve rotation, whereby the port openings can be smaller and less surface is exposed to combustion-chamber pressure and heat.

Other characteristics, advantages and objectives of this invention can be more readily appreciated from the following description and appended claims. When taken in conjunction with the accompanying drawings this description forms a part of the specification wherein like references and characters designate corresponding parts in several views.

DESCRIPTION OF THE DRAWINGS

Referring more particularly to the accompanying drawings which are for illustrative purposes only:

FIG. 3 is an enlarged, cross-sectional view taken substantially along line 3—3 of FIG. 2;

FIG. 4 is an enlarged, cross-sectional view taken substantially along line 4—4 of FIG. 2;

FIG. 5 is a cross-sectional view taken substantially along line 5—5 of FIG. 2, showing the fuel-inlet ports of the fuel passages disposed in the rich-fuel chamber;

DESCRIPTION OF THE PREFERRED EMBODIMENT

Figure 1:
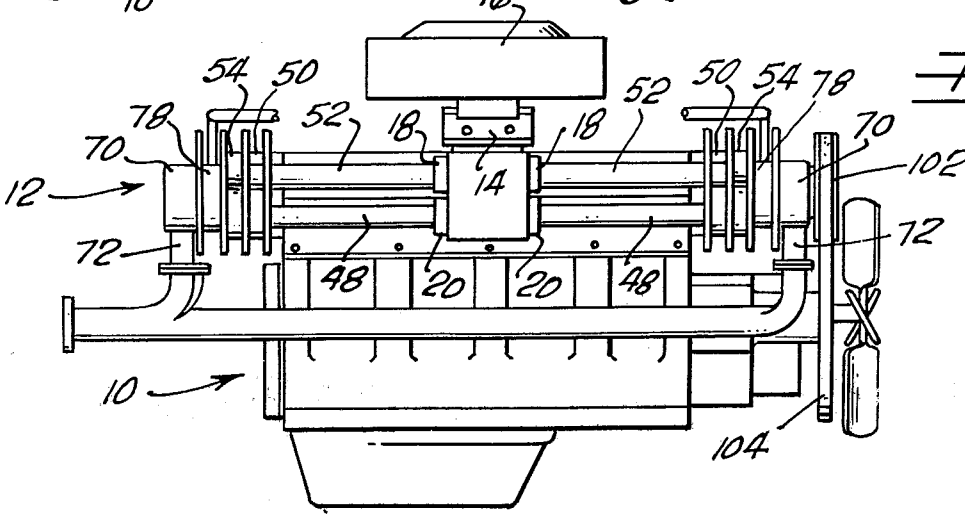
FIG. 1 is a side-elevational view showing the present invention mounted on a conventional internal-combustion engine.

Referring more particularly to the drawings, there is illustrated in FIG. 1 an internal combustion engine, generally indicated at 10, having mounted thereon a rotary-valve device, indicated generally by numeral 12. Included therein are various elements such as the carburetor 14 and its associated air filter 16. The carburetor as shown represents a dual type having lean-fuel outlets 18 and rich-fuel outlets 20. However, it should be noted that separate carburetors can be employed wherein one carburetor is adjusted for a lean-fuel mixture and the second is adjusted for a rich-fuel mixture.

The rotary-valve device comprises an elongated, ported drum or barrel, generally indicated at 22, which is adapted to be positioned longitudinally within a cylinder head 24, wherein the longitudinal axis of said valve drum is disposed at right angles to the cylinders of the engine 10. Said drum 22 is defined by an outer tubular wall, forming a housing 26, and an inner tubular wall 28, forming a co-axial conduit 30, which will hereinafter be described in more detail.

Figure 2:
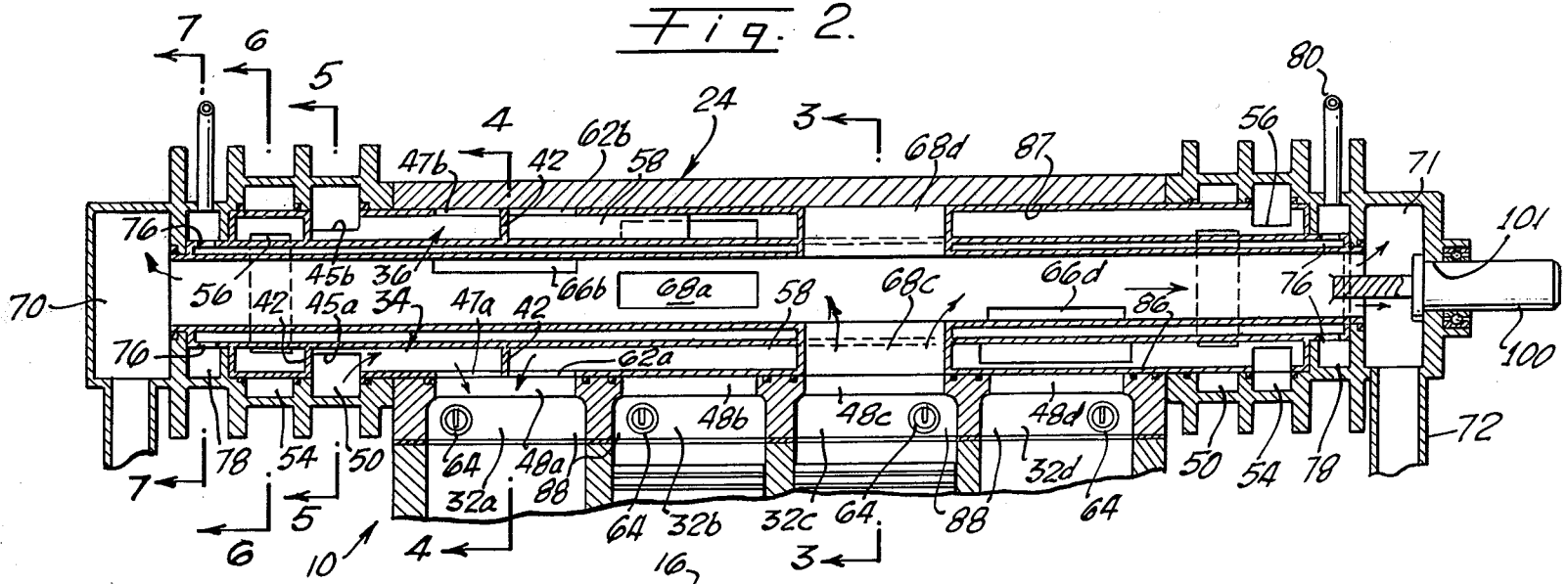
FIG. 2 is a longitudinal cross-section of the rotary-valve device as it is positioned relative to a four-cylinder engine.

Included within the rotary valve device 12 are a fuel-intake system and an exhaust system. The fuel-intake system comprises means to supply a rich-fuel mixture and a lean-fuel mixture to the various combustion chambers designated by numerals **32*a*, 32*b*, 32*c* and 32*d*, as seen in FIG. 2**. These mixtures are supplied separately but simultaneously to each combustion chamber in a proper firing sequence.

Accordingly, the rich-fuel-mixture-supply means comprises a plurality of fuel passages; and, in this particular application of the device, there are four fuel passages 34, 36, 38 and 40, to correspond to respective combustion chambers, **32*a*, 32*b*, 32*c* and 32*d*. Fuel passages 34 and 36 both charge combustion chambers 32*a* and 32*b*, while fuel passages 32 and 40 charge chambers 32*c* and 32*d***.

In order to understand the sequential operation of the rotary valve 10, the placement of the rich-fuel passages must first be described. Thus, referring to FIG. 2, there is illustrated a flat layout pattern having the four rich-fuel passages 34, 36, 38 and 40 positioned on the flat pattern of the wall housing 26, with the combustion chambers **32*a***, *b*, *c* and *d* shown in phantom lines. Therefore, it can be seen that each fuel passage is an enclosed area defined by a continuous peripheral wall 42 interposed between the outer wall housing 26 and an intermediate tubular wall 44, as shown in FIG. 2. Passages 34 and 36 will intermittently charge the respective chambers **32*a* and 32*b*, while passages 38 and 40 will intermittently charge chambers 32*c* and 32*d***.

A rich fuel mixture from the carburetor is allowed to enter the fuel passages by means of inlet ports **45*a*, 45*b*, 45*c* and 45*d*. These inlet ports are formed in the outer wall housing 26 and are positioned to communicate with their respective fuel passages 34, 36, 38 and 40. For clarity, fuel passages 34 and 36 will be referred to as the front passages and passages 38 and 40 as the rear passages. Accordingly, the front fuel passages 34 and 36 are oppositely arranged with respect to passages 38 and 40, whereby inlet ports 45*a* and 45*b* of front passages 34 and 38 are disposed adjacent the forward end of the drum 22, as also seen in FIG. 2, wherein inlet ports 45*c* and 45*d* are disposed adjacent the rearward end of said drum 22. Hence, the rich fuel will enter through any one of the inlet ports 45*a***, *b*, *c* or *d*, into the respective passages, and then discharge through fuel-outlet ports **46*a* through 46*d*, and 47*a* through 47*d*. Therefore, each passage, 34, 36, 37 and 40, is provided with a pair of outlet ports 46*a* and 47*a*; 46*b* and 47*b*; 46*c* and 47*c*; and 46*d* and 47*d*; respectively. Thus, as an example, in FIG. 9 fuel-outlet port 46*a* is positioned over slot 48*b* of combustion chamber 32*b*, whereby rich fuel enters inlet port 45*a* and discharges through 46*a* into chamber 32*b*. However, in FIG. 2, outlet port 47*a* is positioned in communication with combustion chamber 32*a* through slot 48*a* of the cylinder head 24**.

As the valve drum rotates about its longitudinal axis, a continuous flow of rich fuel circulates within all the fuel passages, the fuel being transported from the carburetor means 14 by means of fuel lines or an intake manifold 48 which connects the rich-fuel side of the carburetor 14 to a pair of fuel chambers 50 which are oppositely disposed at each end of the drum 22, wherein said drum is received therethrough to a point where inlet ports 45*a*, *b*, *c* and *d* are positioned within the rich-fuel chambers 50. The rich fuel enters ports 45*a*–45*d* in a flow during the rotation of valve drum 22.

Figure 6:
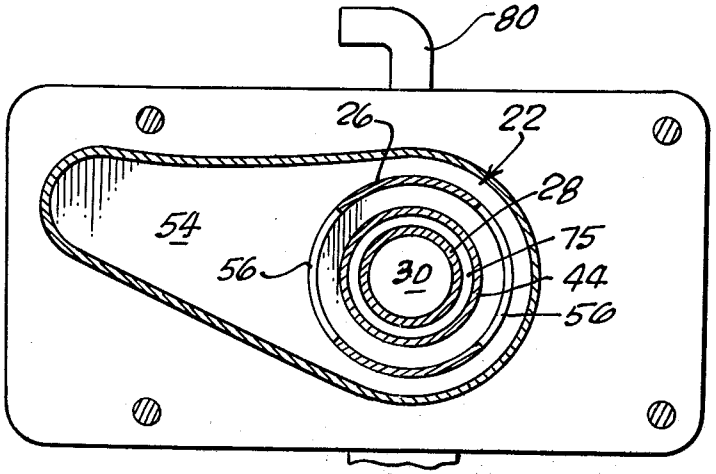
FIG. 6 is a cross-sectional view taken substantially along line 6—6 of FIG. 2, showing the fuel-inlet ports of the lean-fuel compartment being positioned within the lean-fuel chamber.

The lean-fuel mixture is supplied to the valve drum 22 at the same time from carburetor means 14 by way of separate lines or manifold 52 into lean-fuel chambers 54 which are located adjacent respective rich-fuel chambers 50. Lean-fuel inlet ports 56 are disposed in the proximate ends of outer wall housing 26 and are received in each lean-fuel chamber 54, as seen in FIGS. 2 and 6. The lean-fuel-inlet ports communicate with a single, continuous, fuel passage 58 formed between outer wall 26 and inner wall 44, wherein lean fuel enters said passage 58 and discharges through any of the plurality of lean-fuel-outlet ports 60*a*, 60*b*, 60*c*, 60*d*; and 62*b*, 62*c* and 62*d*; respectively.

As can be seen in the various figures, each rich-outlet port is juxtapositioned to a corresponding lean-outlet port — as an example outlet ports 46*a* and 60*a* are positioned together but divided as separate openings by passage partition 42, whereby lean and rich fuel is discharged at the same time. In FIG. 2, rich-fuel outlet 47*a* and lean-fuel outlet 62*a* are shown discharging fuel into combustion chamber 32*a* through slot 48*a*. Also, see FIG. 4 in which lean fuel is flowing from passage 58 through port 62 and into chamber 32*a*. Once the fuel is disposed therein, the spark plug 64 is fired in a conventional manner, thus causing the engine to operate. However, it should be noted that each spark plug 64 is positioned adjacent its respective rich fuel outlet port, as seen in FIG. 2.

Figure 9:
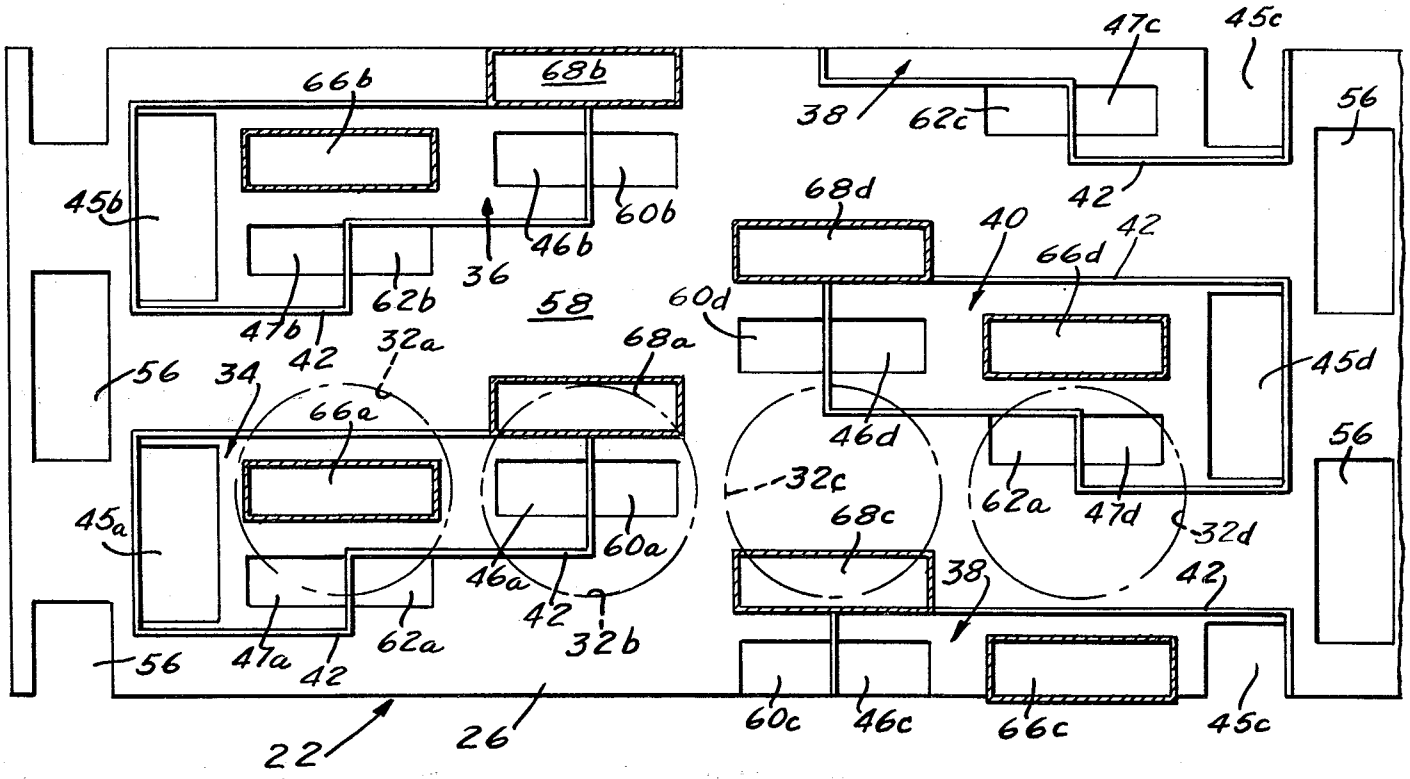
FIG. 9 is a flat layout pattern of the valve drum, indicating the position of the fuel passages and exhaust ports.

Accordingly, an exhaust system must be provided and this, too, is included within the valve drum 22. For each bank of outlet ports, there is provided an exhaust port — that is, ports 47*a* and 62*a* have an associated exhaust port 66*a*, and ports 46*a* and 60*a* have a respective exhaust port 68*a*. Hence, the valve device 10 incorporates exhaust ports 66*a*–66*d* and 68*a*–68*d*. Said exhaust port 66*a* in FIG. 9 is shown aligned with chamber 32*c*, whereby exhaust from chamber 32*c* discharges through port 68*c* defined by a walled passage communicating with the inner conduit 30. Exhaust from the exhaust ports 66*a*–66*d* and 68*a*–68*d* passes through conduit 30 and discharges from its open ends which terminate in exhaust chambers 70 and 71. Said exhaust chambers 70 and 71 are provided with outlet extension 72, to which various well known exhaust means are connected, such as indicated at 74.

Figure 8:
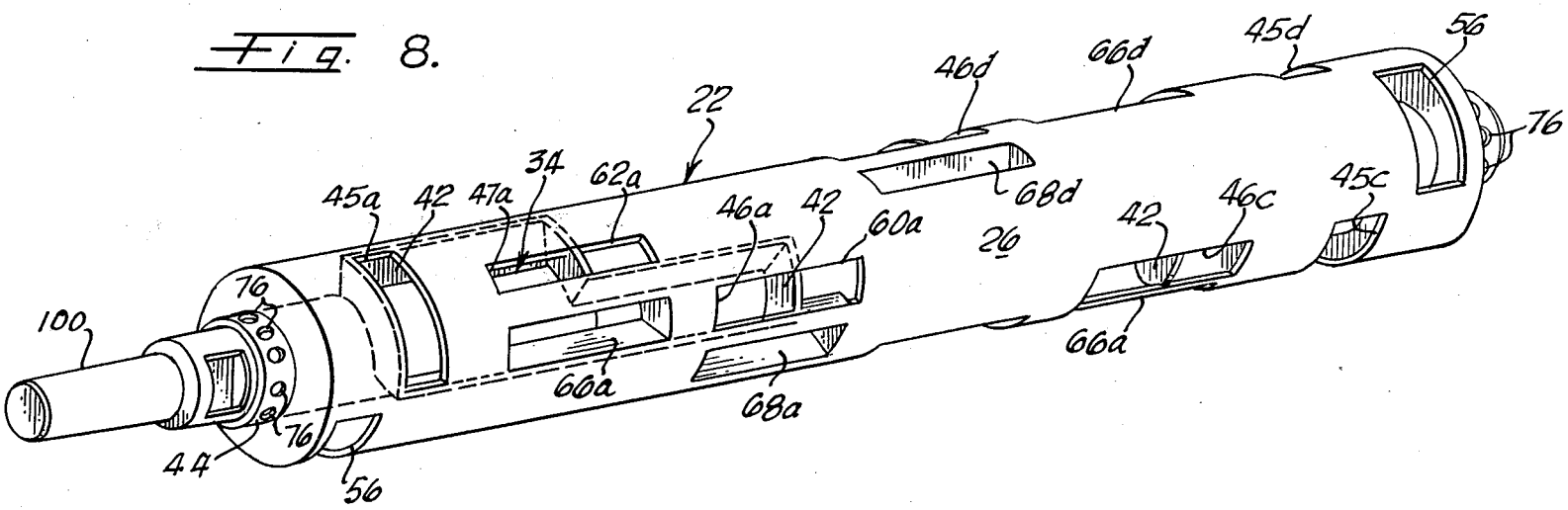
FIG. 8 is a perspective view of the rotary valve.
Figure 7:
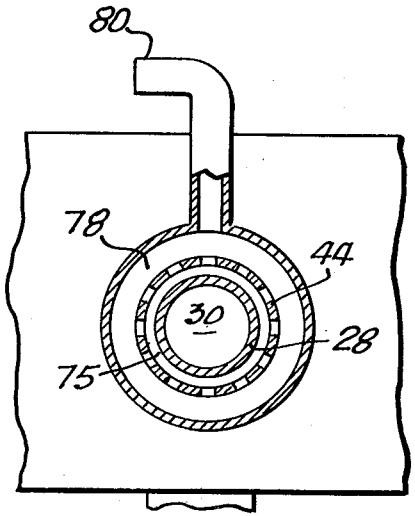
FIG. 7 is an enlarged, cross-sectional view taken substantially along line 7—7 of FIG. 2, showing a portion of the water-cooling system.

A cooling means is provided within the valve device 10 whereby an even temperature can be maintained. In doing so, expansion and contraction of the device is held to a minimum — thus insuring an efficient seal thereof within the cylinder head. The cooling means comprises the area forming a cooling jacket 75, interposed between wall 28 and wall 44, having a plurality of apertures 76 disposed within the wall 44 adjacent the terminating ends thereof. These apertures 76 are received within a compartment 78 which, in turn, is connected to the engine's water-cooling system by means of conduits 80, as seen in FIG. 8. Hence, the cooling fluid is continuously allowed to flow through jacket 75 during the engine's operation.

In order to provide easy access and maintenance of the valve device, the cylinder head 24 in which the device is disposed comprises a main cradle head 82 and a cover head 84. Each is provided with semi-annular channels 86 and 87. The cradle head 82 is secured to the main engine block, as seen in FIGS. 3 and 4, and includes therein longitudinal slots 48*a*–48*d* which communicate with the firing chamber recesses 88 formed in the lower surface of the head 82, having cover plates 92 secured and sealed thereover. Adapted to be mounted in head 82 are conventional spark plugs 64 which are received in plug openings 94.

The cover head 84 is secured to the cradle head 82 by well known engine bolts 95, at which time valve device 22 is operably positioned in channels 86 and 87, said heads 82 and 84 having sealing means 96 positioned therebetween. Suitable sealing rings are also provided within the cradle head 82 and are positioned about each elongated slot 48*a*–48*d*, thus preventing loss of compression during the firing cycle of the engine.

To impart the rotational movement of the valve device 10, the forward end thereof includes co-axial drive shaft 100 which extends outwardly from the forward exhaust chamber 71, said chamber being provided with an opening 101 therein through which shaft 100 is received and supported. Said drive shaft is adapted to have a pully 102 mounted thereon so as to be operably connected to the engine drive by a belt 104. The belt 104 and the engine drive are conventional and may include various idle pullies (not shown) to provide the proper timing and rotational ratio. However, the ratio between the crankshaft rotation and the rotation of the valve drum is 4:1, due to the arrangement of the fuel-outlet port with respect to corresponding exhaust ports.

As can be seen in FIGS. 3 and 4, each fuel-outlet port has a diametrically disposed, fuel-outlet port; and each exhaust port has a diametric, oppositely arranged, exhaust port. In FIG. 3, exhaust port 68*d* is positioned 180° to its corresponding exhaust port 68*c*; and fuel-outlet ports 46*c* and 46*d* are, also, positioned 180° apart on the valve drum. FIG. 4 shows fuel outlet ports 62*b* and 62*a* as being oppositely disposed to each other. Therefore, each fuel-outlet port and exhaust port has a corresponding port positioned 180° therefrom; hence, two complete firings of the four-cylinder banks occur during one revolution of the valve drum. Accordingly, one revolution of the valve drum completes two, four-cycle operations of the crankshaft. This results in less wear due to the slow valve rotation and allows for smaller port openings, together with less surface exposed to combustionchamber pressures and heat.

The invention and its attendant advantages will be understood from the foregoing description it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. A single rotary-valve device for a four stroke internal-combustion engine, arranged to simultaneously release separate rich and lean fuel mixtures therefrom into each combustion chamber of said engine, wherein the device comprises:

an elongated tubular drum defined by an outer wall housing;

an exhaust-manifold means disposed within said tubular drum for rotation therewith;

a fuel-intake system disposed in said drum and having a rich-fuel-intake means and a lean-fuel-intake means;

a cooling means positioned between said exhaust-manifold means and said fuel-intake system.

2. A rotary-valve device as recited in claim 1, wherein said rich-fuel-intake means comprises a plurality of rich-fuel passages, each of said passages having an inlet port and at least one outlet port disposed in said peripheral wall housing; and wherein said lean-fuel-intake means comprises at least one fuel passage having a plurality of inlet ports and a plurality of outlet ports, said ports being disposed in said peripheral wall housing of said drum, and wherein said rich and lean outlet ports are juxtapositioned for separate but simultaneous discharge of respective fuel mixtures therefrom.

3. A rotary valve device as recited in claim 2, wherein said exhaust-manifold means comprises:

a co-axial conduit defined by an inner, annular wall of said drum, said conduit being opened at each end thereof whereby exhaust is discharged therefrom; and a plurality of radially extending, exhaust ports forming communicating passages between said conduit and said outer wall housing for sequential communication with each respective combustion chamber.

4. A rotary-valve device as recited in claim 3, wherein said cooling means comprises a water jacket longitudinally formed by said inner, annular wall and a corresponding, intermediate, annular wall, whereby cooling fluid passes therethrough, said intermediate, annular wall extending longitudinally outward from said outer wall housing and having a plurality of apertures disposed therein.

5. A rotary-valve device as recited in claim 3, wherein each of said rich-outlet ports is juxtapositioned relative to a corresponding lean-outlet port, whereby the separate discharge of fuel therefrom combines to provide a stratified charge within the engine's combustion chamber.

6. A rotary-valve device as recited in claim 5, wherein each of said exhaust ports is annually aligned and sequentially juxtaposed to corresponding rich and lean fuel-outlet ports.

7. A rotary-valve device as recited in claim 5, wherein said valve device includes a pair of exhaust chambers oppositely disposed at each end of said exhaust conduit wherein said open ends thereof terminate within said exhaust chambers.

8. A rotary-valve device as recited in claim 7, wherein said valve device includes:

a pair of rich-fuel chambers, each being adapted to receive the opposite ends of said drum therein, and wherein said rich-fuel-inlet ports are rotatably positioned therein; and a pair of lean-fuel chambers, each being adapted to receive the opposite ends of said drum therein, and wherein said lean-fuel-inlet ports are rotatably positioned therein.

9. A rotary-valve device as recited in claim 4, wherein said valve device includes a pair of water-cooling compartments adapted to receive said apertures disposed in said extended ends of said intermediate, annular wall, whereby cooling fluid is received from the engine's cooling system and circulated therethrough.

10. A rotary-valve device as recited in claim 8, wherein said valve device includes a co-axial drive shaft extending from one end of said drum.

11. A rotary-valve device as recited in claim 10, wherein said valve device includes a cylinder block having a main cradle-head portion and a cover-head portion, said cradle-head and said cover-head portions being provided with longitudinal, semi-annular channels, whereby said drum is operably supported therein.

12. A rotary-valve device as recited in claim 11, wherein said main cradle head includes:

a plurality of recessed firing chambers, each having a longitudinal slot therein, whereby said fuel and said exhaust can pass therethrough;

a sealing ring positioned about each of said slots for direct engagement with said valve drum; and a water jacket formed within said cradle head.

13. A rotary-valve device as recited in claim 12, wherein said engine includes a plurality of spark plugs terminating in said combustion chamber and juxtapositioned under the corresponding rich-fuel-outlet ports, whereby said rich fuel is first to ignite therein.

* * * * *